US012258895B1

(12) United States Patent
Khunte et al.

(10) Patent No.: US 12,258,895 B1
(45) Date of Patent: Mar. 25, 2025

(54) SAFETY COMPLIANT CATALYST HEATING AFTERTREATMENT SYSTEM

(71) Applicant: Cummins Inc., Columbus, IN (US)

(72) Inventors: Abhishek Khunte, Maharashtra (IN); William D. Meyer, Columbus, IN (US); Marvin Karugarama, Indianapolis, IN (US); Kyle Robert Fath, Greenwood, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 18/536,379

(22) Filed: Dec. 12, 2023

(51) Int. Cl.
*F01N 3/20* (2006.01)

(52) U.S. Cl.
CPC ..... *F01N 3/2013* (2013.01)

(58) Field of Classification Search
CPC . F01N 9/00; F01N 11/00; F01N 3/027; F01N 3/2013; F01N 5/02; F01N 11/002; F01N 2240/16; F01N 2900/04
See application file for complete search history.

(56) References Cited

U.S. PATENT DOCUMENTS

H1113 H * 12/1992 Yoshizaki ..... F01N 3/2013 60/299
5,390,493 A * 2/1995 Fujishita ..... F01N 9/00 60/284
9,296,372 B2 * 3/2016 Tsunekawa ..... B60T 7/22
11,931,865 B2 * 3/2024 Benson ..... B22F 1/052
2011/0155108 A1 * 6/2011 Russ ..... F02D 23/00 60/602
2023/0383679 A1 * 11/2023 Brand ..... F01N 9/00
2024/0088386 A1 * 3/2024 Nishimura ..... H01M 10/635

FOREIGN PATENT DOCUMENTS

CN 108749648 11/2018
CN 208842234 5/2019
CN 209381811 9/2019

* cited by examiner

*Primary Examiner* — Anthony Ayala Delgado
(74) *Attorney, Agent, or Firm* — Taft, Stettinius & Hollister LLP

(57) ABSTRACT

A power converter apparatus includes a parent circuit board comprising a first surface, a second surface, and a thermal conductor core disposed intermediate the first surface and the second surface. A first child circuit is board mounted on the parent circuit board. A first plurality of power switches are mounted on the first child circuit board. A second child circuit is board mounted on the parent circuit board. A second plurality of power switches are mounted on the second child circuit board. A first heat transfer circuit includes a first set of conductors thermally conductively coupling the first plurality of power switches with the thermal conductor core. A second heat transfer circuit includes a second set of conductors thermally conductively coupling the second plurality of power switches with the thermal conductor core.

22 Claims, 7 Drawing Sheets

SAFETY COMPLIANT CATALYST HEATING AFTERTREATMENT SYSTEM

BACKGROUND

The present application relates to safety compliant catalyst heating aftertreatment systems and related apparatuses, processes, systems and techniques. A number of proposals have been made for heating catalysts of aftertreatment systems for internal combustion systems. Existing approaches to aftertreatment catalyst heating suffer from a number of disadvantages, drawbacks, problems, and shortcomings including those respecting complexity, cost, reliability, and safety, among others. There remains a significant need for the unique apparatuses, processes, and systems disclosed herein.

DISCLOSURE OF EXAMPLE EMBODIMENTS

For the purposes of clearly, concisely, and exactly describing example embodiments of the present disclosure, the manner, and process of making and using the same, and to enable the practice, making and use of the same, reference will now be made to certain example embodiments, including those illustrated in the figures, and specific language will be used to describe the same. It shall nevertheless be understood that no limitation of the scope of the invention is thereby created, and that the invention as set forth in the claims following this disclosure includes and protects such alterations, modifications, and further applications of the example embodiments as would occur to one skilled in the art with the benefit of the present disclosure.

SUMMARY OF THE DISCLOSURE

Some embodiments include unique safety compliant catalyst heating aftertreatment apparatus. Some embodiments include unique safety compliant catalyst heating aftertreatment systems. Some embodiments include unique safety compliant catalyst heating aftertreatment processes. Further embodiments, forms, objects, features, advantages, aspects, and benefits shall become apparent from the following description and drawings.

DETAILED DESCRIPTION OF EXAMPLE EMBODIMENTS

Figure 1:
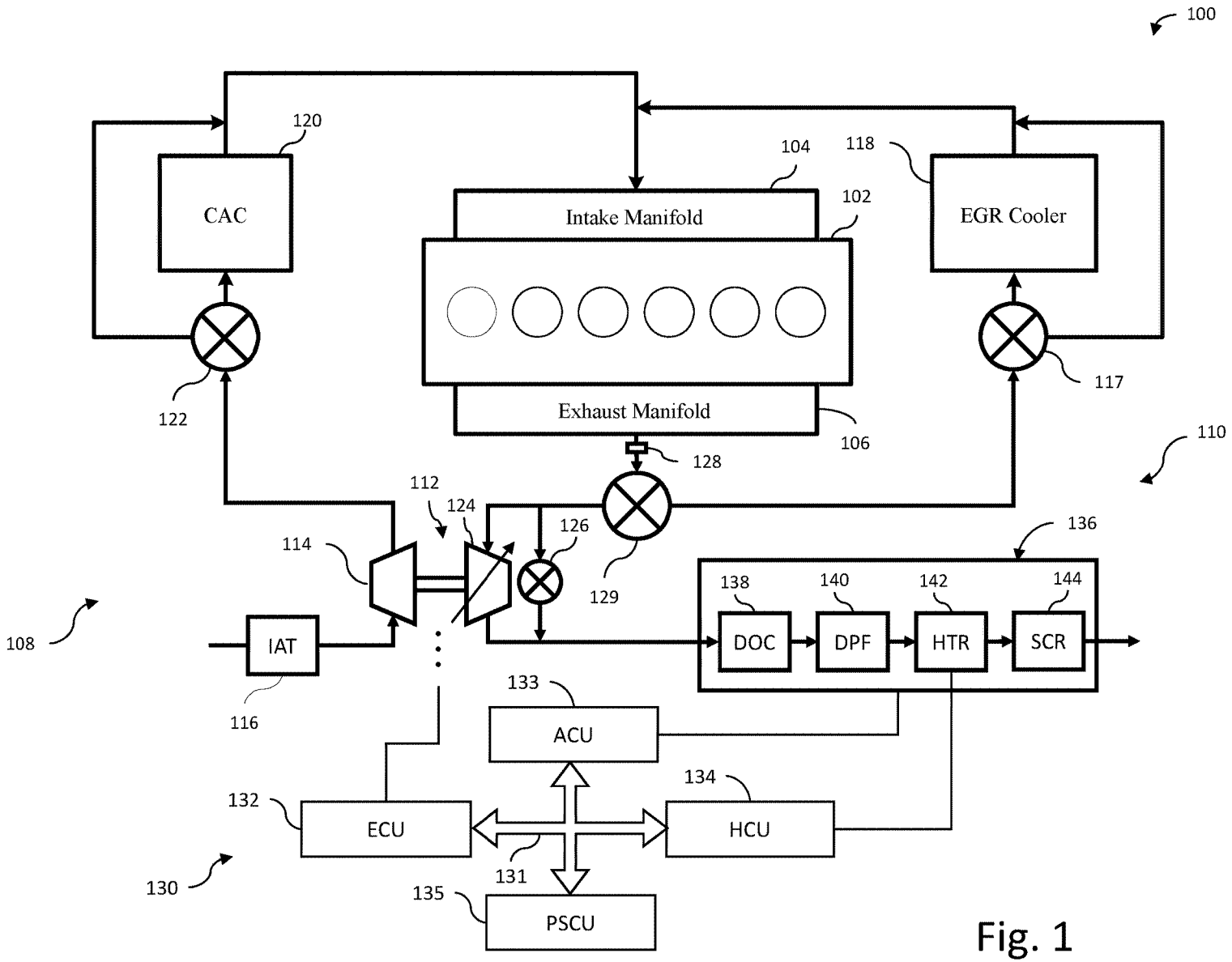
FIG. 1 is a schematic diagram illustrating certain aspects of an example prime mover system.

With reference to FIG. 1, there is illustrated an example prime mover system 100 (also referred to herein as system 100) including a prime mover in the form of an internal combustion engine (ICE) 102. System 100 may be provide in a number of forms including, for example, in the form of a vehicle or vehicle powertrain system (e.g., an on-highway vehicle or vehicle powertrain system or an off-highway vehicle or vehicle powertrain system), a work machine or work machine powertrain system, a genset or genset powertrain system, or a hydraulic fracturing rig or hydraulic fracturing rig powertrain system, to name several non-limiting examples. In shall be appreciated that system 100 may include a number of other components as will occur to one of skill in the art with the benefit and insight of the present disclosure. Furthermore, while engine 102 is provided as a prime mover of system 100 in the illustrated embodiment, other embodiments may comprise other types of prime movers, for example, battery electric drive systems, hybrid ICE-battery electric systems, a fuel cell electric drive system, or prime mover systems comprising combinations of the foregoing and/or other types of prime mover system as will occur to one of skill in the art with the benefit and insight of the present disclosure.

System 100 includes an intake system 108 and an exhaust system 110. The engine 102 is in fluid communication with the intake system 108 through which charge air enters an intake manifold 104 and is also in fluid communication with the exhaust system 110, through which exhaust gas resulting from combustion exits by way of an exhaust manifold 106. The engine 102 includes a number of cylinders (e.g., cylinders 1 through 6) forming combustion chambers in which a charge flow mixture of fuel and air is combusted. For example, the energy released by combustion powers the engine 102 via pistons in the cylinders connected to a crankshaft. Intake valves control the admission of charge air into the cylinders, and exhaust valves control the outflow of exhaust gas through exhaust manifold 106 and ultimately to the atmosphere. It shall be appreciated that the exhaust manifold 106 may be a single manifold or multiple exhaust manifolds.

The turbocharger 112 includes a compressor 114 configured to receive filtered intake air via an intake air throttle (IAT) 116 of the intake system 108 and operable to compress ambient air before the ambient air enters the intake manifold 104 of the engine 102 at increased pressure. The air from the compressor 114 is pumped through the intake system 108, to the intake manifold 104, and into the cylinders of the engine 102, typically producing torque on the crankshaft. IAT 116 is flow coupled with a charge air cooler (CAC) 120 which is operable to cool the charge flow provided to the intake manifold 104. The intake system 108 also includes a CAC bypass valve 122 which can be opened to route a portion or all of the charge flow to bypass the CAC 120. Adjusting the bypass position of the CAC bypass valve 122 increasingly raises the temperature of the gas returned to the intake manifold 104.

It is contemplated that in system 100, the turbocharger 112 may be a variable geometry turbocharger (VGT) or a fixed geometry turbocharger. A variable geometry turbine allows significant flexibility over the pressure ratio across the turbine. In diesel engines, for example, this flexibility can be used for improving low speed torque characteristics, reducing turbocharger lag and driving exhaust gas recirculation flow. In an example embodiment, the VGT 124 can be adjusted to increase engine load and thereby configured to increase exhaust gas temperature. System 100 also includes a turbine bypass valve 126 to bypass the turbocharger 112. Since cooler ambient air is introduced at the turbocharger 112, opening the turbine bypass valve 126 allows for the turbocharger 112 to be bypassed and maintain a higher intake air temperature at the intake manifold 104.

The exhaust system 110 includes an exhaust gas temperature sensor 128 to sense the temperature of the gas exiting the exhaust manifold 106. The exhaust system 110 includes an exhaust gas recirculation (EGR) valve 129 which recirculates a portion of exhaust gas from the exhaust manifold 106 back to the intake manifold 104. The exhaust system 110 includes an EGR cooler (EGR-C) 118 which cools the gas exiting the exhaust manifold 106 before the gas returns to the intake manifold 104. The exhaust system 110 may also include an EGR-C bypass valve 117 which can be opened to route a portion or all of the recirculated exhaust gas from the exhaust manifold 106 to bypass the EGR-C 118. By increasing the amount of gas that bypasses the EGR-C 118, the temperature of the gas returning to the intake manifold 104 is increased. It shall be appreciated that the intake system 108 and/or the exhaust system 110 may further include various components not shown, such as additional coolers, valves, bypasses, intake throttle valves, exhaust throttle valves, and/or compressor bypass valves, for example.

System 100 includes an exhaust aftertreatment (AT) system 136 which includes a diesel oxidation catalyst (DOC) 138, a diesel particulate filter (DPF) 140, aftertreatment (AT) heater 142, and a selective catalytic reduction (SCR) 144. In the example embodiment, the AT heater 142 is optionally included in the AT system 136 to increase the temperature of the exhaust gas provided to the SCR 144 within the AT system 136. It should be noted that AT heater 142 can include one or more electric heaters distributed at various locations at, on, within, or upstream of SCR 144 or other catalyst elements of AT system 136.

System 100 includes an electronic control system (ECS) 130. In the illustrated embodiment, ECS 130 include an engine control unit (ECU) 132, an aftertreatment control unit (ACU) 133, a heater control unit (HCU) 134, and power system control unit (PSCU) 135 which are operatively communicatively coupled with one another via one or more datalinks 131 which may comprise one or more controller area networks (CAN) and/or other types of datalinks. System 100 may include a number of other control units and controller as will occur to one of skill in the art with the benefit and insight of the present disclosure.

ECU 132 is operatively communicatively coupled with and configured and operable to control operation of and/or receive inputs from actuators, controllers, devices, sensors, and/or other components of system 100 including, for example, a number of the aforementioned features of system 100.

HCU 134 is operatively coupled with and configured and operable to control operation of and/or receive inputs from AT heater 142. It shall be appreciated that various communications hardware and protocols may be utilized to implement, such as one or more controller area networks (CAN) or other communications components.

PSCU 135 operatively communicatively coupled with and configured and operable to control operation of and/or receive inputs from an electrical power system of system 100 such as, for example, a motor generator system, a battery system, or other types of electrical power systems.

ECU 132, ACU 133, HCU 134, PSCU 135, and other components of ECS 130 may include one or more programmable controllers of a solid-state, integrated circuit type, and one or more non-transitory memory media configured to store instructions executable by the one or more microcontrollers. For purposes of the present application the term controller shall be understood to also encompass microcontrollers, microprocessors, application specific integrated circuits (ASIC), other types of integrated circuit processors and combinations thereof.

ECU 132, ACU 133, HCU 134, PSCU 135, and other components of ECS 130 may be implemented in any of a number of ways that combine or distribute the control function across one or more control units in various manners. The ECS 130 may execute operating logic that defines various control, management, and/or regulation functions. This operating logic may be in the form of dedicated hardware, such as a hardwired state machine, analog calculating machine, programming instructions, and/or a different form as would occur to those skilled in the art. The ECS 130 may be provided as a single component or a collection of operatively coupled components; and may be comprised of digital circuitry, analog circuitry, or a hybrid combination of both of these types. When of a multi-component form, the ECS 130 may have one or more components remotely located relative to the others in a distributed arrangement. The ECS 130 can include multiple processing units arranged to operate independently, in a pipeline processing arrangement, in a parallel processing arrangement, or the like. It shall be further appreciated that the ECS 130 and/or any of its constituent components may include one or more signal conditioners, modulators, demodulators, Arithmetic Logic Units (ALUs), Central Processing Units (CPUs), limiters, oscillators, control clocks, amplifiers, signal conditioners, filters, format converters, communication ports, clamps, delay devices, memory devices, Analog to Digital (A/D) converters, Digital to Analog (D/A) converters, and/or different circuitry or components as would occur to those skilled in the art to perform the desired communications.

ECU 132, ACU 133, HCU 134, PSCU 135, and other components of ECS 130 may include one or more non-transitory memory devices configured to store instructions in memory which are readable and executable by a controller to control operation of engine 102 as described herein. Certain control operations described herein include operations to determine one or more parameters. ECU 132, ACU 133, HCU 134, PSCU 135, and other components of ECS 130 may be configured to determine and may perform acts of determining in a number of manners, for example, by calculating or computing a value, obtaining a value from a lookup table or using a lookup operation, receiving values from a datalink or network communication, receiving an electronic signal (e.g., a voltage, frequency, current, or pulse-width modulation (PWM) signal) indicative of the value, receiving a parameter indicative of the value, reading the value from a memory location on a computer-readable medium, receiving the value as a run-time parameter, and/or by receiving a value by which the interpreted parameter can be calculated, and/or by referencing a default value that is interpreted to be the parameter value.

Figure 2:
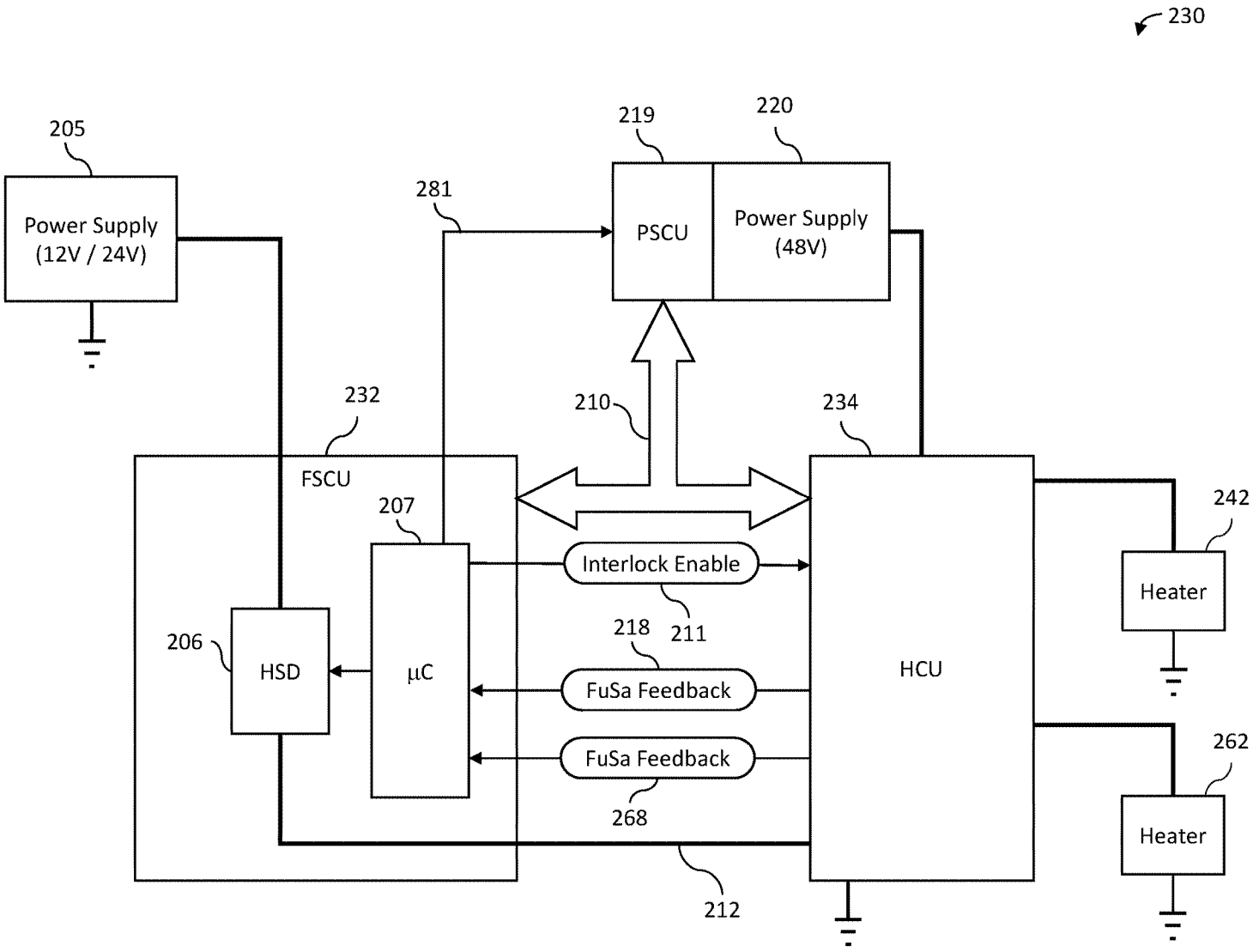
FIGS. 2, 3, 4, 5, and 6, are schematic diagrams illustrating certain aspects of example electronic control system implementations.
Figure 3:
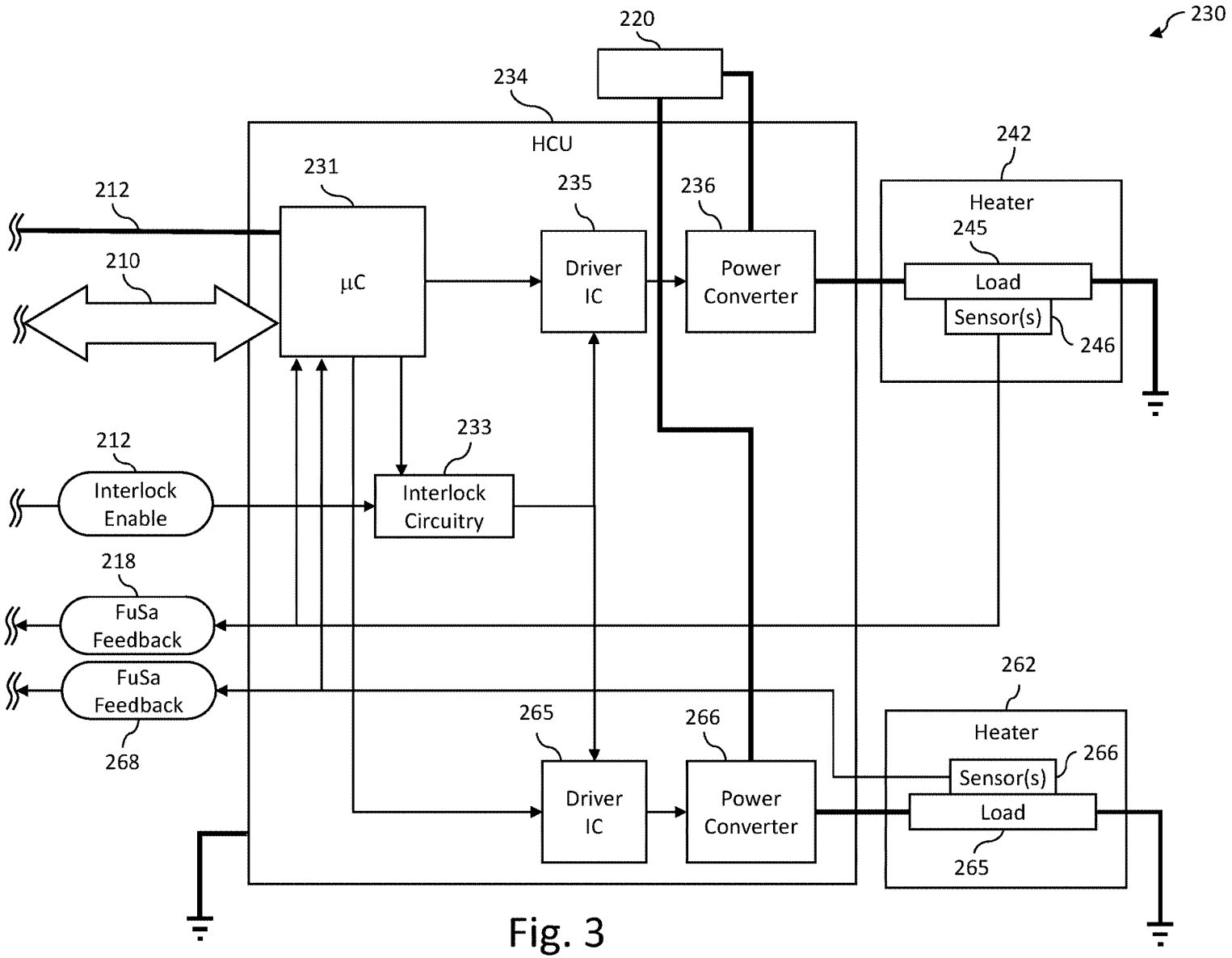

With reference to FIGS. 2 and 3, there are illustrated certain aspects of an example electronic control system (ECS) 230. In the illustrated example, ECS 230 includes a first electronic control unit which is configured and provided in the form of heater control unit (HCU) 234. In the illustrated example, ECS 230 also includes, a second electronic control unit which is configured and provided in the form of functional safety control unit (FSCU) 232. In the illustrated example, ECS 230 further includes a third electronic control unit which is configured and provided in the form of power system control unit (PSCU) 219.

ECS 230 is one example of an electronic control system including at least one electronic control unit configured to satisfy a predetermined functional safety (FuSa) requirement and at least one other electronic control configured not to satisfy the FuSa requirement. It shall be appreciated that functional safety may be formally defined as absence of a defined risk due to hazards caused by malfunctioning behavior of electrical and/or electronic systems. A number of predetermined FuSa requirements are contemplated according to the preset disclosure including, for example, the automotive safety integrity level (ASIL) requirements of the ISO 26262 standard, namely ASIL A, ASIL B, ASIL C, and ASIL D requirements. Furthermore, an electronic control unit may be configured not to satisfy a given FuSa requirement due to its satisfying only a lower FuSa requirement, for example, a requirement of a lower ASIL, or by not satisfying any FuSa requirement, for example, being configured according to the quality management (QM) level requirements of the ISO 26262 standard.

In the illustrated example, FSCU 232 is configured to meet a predetermined FuSa requirement. In some embodiments, for example, FSCU 232 may be configured to meet FuSa requirements of ASIL C. In other embodiments, FSCU 232 may be configured to meet other FuSa requirements, for example, requirement of another ASIL level or other FuSa requirements according to other standards.

HCU 234 is configured not to meet the predetermined FuSa requirements which FSCU 232 is configured to meet. In some embodiments, for example, HCU 234 may be configured to satisfy quality management (QM) requirements, and not to meet any ASIL level. In other embodiments, HCU 234 may be configured to meet a lower FuSa requirement than FSCU 232, for example, a lower ASIL level than FSCU 232 or a lower level of other FuSa requirements.

In some embodiments, PSCU 219 may be configured to meet the predetermined FuSa requirements which FSCU 232 is configured to meet or to meet a higher FuSa requirement, such as a higher ASIL level. In some embodiments, PSCU 219 may be configured not to meet the predetermined FuSa requirements which FSCU 232 is configured to meet. In some embodiments, for example, PSCU 219 may be configured to satisfy quality management (QM) requirements, and not to meet any ASIL level. In other embodiments, PSCU 219 may be configured to meet a lower FuSa requirement than FSCU 232, for example, a lower ASIL level than FSCU 232 or a lower level of other FuSa requirements.

In the illustrated example, HCU 234 is configured and provided with two output channels. A first output channel of HCU 234 is configured to drive heater 242 using power from power supply (PS) 220 and power converter 236 which is operatively coupled with and configured to receive power from power supply 220 to selectably power load 245 of heater 242. A second output channel of HCU 234 is configured to drive heater 262 using power from power supply 220 and power converter 266 which is operatively coupled with and configured to receive power from power supply 220 to selectably power load 265 of heater 262.

PSCU 219 is configured and operable to control operation of power supply 220. power supply 220 may be configured and provided in a number of forms including, for example, electrical power systems including a battery-based power source, an alternator-based or generator-based power source, a battery and alternator or generator-based power source, or other types of electrical power source as will occur to one of skill in the art with the benefit and insight of the present disclosure. In some embodiments, electrical power source may be configured and provided as a 48V DC electrical power source.

It shall be appreciated that ECS 130 of system 100 may be configured and provided in forms according to ECS 230 or variations thereof. In some such forms, HCU 134 may correspond to HCU 234 and heater 242 may correspond to heater 142. In some such forms, FSCU 232 may correspond to ECU 132. In some such forms, FSCU 232 may correspond to ACU 133. In some such forms, FSCU 232 may correspond to another electronic control unit of ECS 130. In some such forms, PSCU 219 may correspond to PSCU 135.

FSCU 232 is configured to send communication to HCU 234 and receive communication from HCU 234 via one or more datalinks 210 which may be configured and provided, for example, as one or more controller area networks (CAN) or one or more other types of data links. FSCU 232 is also configured to provide electrical power via line 212 and interlock enable signal 211 to HCU 234. FSCU 232 is further configured to receive FuSa feedback 218 and FuSa feedback 268 from HCU 234.

FSCU 232 supplies power from power supply 205 to HCU 234 via line 212 and high side driver (HSD) 206. In the illustrated embodiment power supply 205 is provided separately from power supply 220 and is configured to supply electrical power at a lower voltage than power supply 220. In some embodiments, for example, power supply 205 may comprises a 12V or a 24V electrical power supply. In other embodiment, power supply 205 may be configured to provide power at the same voltage as power supply 220. In some such embodiments, power supply 205 and power supply 220 may be combined or may comprise one and the same power supply. HSD 206 includes one or more switches that are controlled by microcontroller 207 to selectably turn on a supply of electrical power to HCU 234 and to turn off the supply of electrical power from power supply 205 to HCU 234.

Microcontroller 207 is configured to receive FuSa feedback 218 and FuSa feedback 268 from HCU 234 and to evaluate or process FuSa feedback 218 and FuSa feedback 268 to evaluate one or more FuSa conditions and to perform one or more FuSa operations. A number of types of FuSa feedback, FuSa evaluations, and FuSa operations are contemplated.

In some embodiments, FuSa feedback 218 may comprise one or more voltage values which may be evaluated by microcontroller 207 relative to one or more voltage thresholds to evaluate or identify an under-voltage and/or over-voltage condition of heater 242. Similarly FuSa feedback 268 may comprise one or more voltage values which may be evaluated by microcontroller 207 relative to one or more voltage thresholds to evaluate or identify an under-voltage and/or over-voltage condition of heater 262.

In some embodiments, FuSa feedback 218 may consist of or may consist essentially of one or more voltage values which may be evaluated by microcontroller 207 relative to one or more voltage thresholds to evaluate or identify an under-voltage and/or over-voltage condition of heater 242. Similarly FuSa feedback 268 may consist of or may consist essentially of one or more voltage values which may be evaluated by microcontroller 207 relative to one or more voltage thresholds to evaluate or identify an under-voltage and/or over-voltage condition of heater 262.

In some embodiments, FuSa feedback 218 may comprise one or more current values which may be evaluated by microcontroller 207 relative to one or more current thresholds to evaluate or identify an under-voltage and/or over-voltage condition of heater 242. Similarly, FuSa feedback 268 may comprise one or more current values which may be evaluated by microcontroller 207 relative to one or more current thresholds to evaluate or identify an under-voltage and/or over-voltage condition of heater 262.

In some embodiments, FuSa feedback 218 may comprise one or more temperature values which may be evaluated by microcontroller 207 relative to one or more temperature thresholds to evaluate or identify an over-temperature condition of heater 242. Similarly, FuSa feedback 268 may comprise one or more temperature values which may be evaluated by microcontroller 207 relative to one or more temperature thresholds to evaluate or identify an over-temperature condition of heater 262.

In some embodiments, FuSa feedback 218 and FuSa feedback 268 may comprise combinations of the foregoing values or other values which may be evaluated by microcontroller 207 relative to corresponding thresholds.

Microcontroller 207 may be configured to perform a number of FuSa operations. In some embodiments, in response to an evaluation or determination of either one or both of FuSa feedback 218 indicating a fault condition of heater 242 and FuSa feedback 268 indicating a fault condition of heater 262, microcontroller 207 may set interlock enable 211 to a logical false value and output the same to interlock circuitry 233 of HCU 234. In response, interlock circuitry 233 may disable one or both of operation of HCU 234 to drive load 245 of heater 242 and operation of HCU 234 to drive load 265 of heater 262. Such disabling may occur, for example, by disabling operation of driver integrated circuit (IC) 235 and/or power converter 236.

In some instances, disabling performed in connection with interlock may be channel specific such that a determination of FuSa feedback 218 indicating a fault condition of heater 242 is effective to disable only operation of HCU 234 to drive load 245 of heater 242, and a determination of FuSa feedback 268 indicating a fault condition of heater 262 is effective to disable only operation of HCU 234 to drive load 265 of heater 262. In some instances, such disabling may be channel non-specific or channel independent such that a determination of either or both FuSa feedback 218 indicating a fault condition of heater 242 and FuSa feedback 268 indicating a fault condition of heater 262 is effective to is effective to disable operation of HCU 234 to drive load 245 of heater 242 and to disable operation of HCU 234 to drive load 265 of heater 262.

In some embodiments, in response to an evaluation or determination of either one or both of FuSa feedback 218 indicating a fault condition of heater 242 and FuSa feedback 268 indicating a fault condition of heater 262, microcontroller 207 may control HSD 206 to turn off or disable a supply of power to HCU 234 via line 212 which, in turn, is effective to disable operation of microcontroller 231, driver IC 235, power converter 236, driver IC 265, and power converter 266.

In some embodiments, in response to an evaluation or determination of either one or both of FuSa feedback 218 indicating a fault condition of heater 242 and FuSa feedback 268 indicating a fault condition of heater 262, microcontroller 207 may send one or more commands to HCU 234 via datalink 210 which may be executed by microcontroller 231 to end or suspend operation of one or both of driver IC 235 and power converter 236, and driver IC 265 and power converter 266.

In some embodiments, microcontroller 207 may be configured to implement and execute combinations of any pair of the foregoing FuSa operations or a combination of all three of the foregoing operations. Microcontroller 207 may also be configured to implement and execute other functional safety logic and operations, for example, as further described elsewhere herein. It shall be further appreciated that microcontroller 207 and/or microcontroller 231 may be configured to perform a number of diagnostics in response to the FuSa feedbacks disclosed herein. Example of such diagnostics include first order diagnostics such as over-voltage fault, under-voltage fault, over-current fault, under-current fault, and over temperature fault conditions. Further examples of such diagnostics include higher order diagnostics such as diagnostics or prognostics indicative of current or future component malfunction or failure which may be based upon trends and other analytics performed on multiple instance of first order diagnostics and various other diagnostics.

FSCU 232 supplies electrical power via line 212 to microcontroller 231. In some embodiments, FSCU 232 may additionally supply electrical power via line 212 to driver IC 235, driver IC 265, and interlock circuitry 233, as well as to other control circuitry of HCU 234. FSCU 232 may also selectably supply enable signals and control signals to microcontroller 231 via one or more datalinks 210 to selectably enable and command operation of microcontroller 231 to control driver IC 235 and power converter 236 to drive a load 245 of heater 242 and to selectably enable and command operation of microcontroller 231 to control driver IC 265 and power converter 266 to drive a load 265 of heater 262. Additional control signals may be similarly provided to cause microcontroller 231 to enter a sleep mode or to wake from a sleep mode or otherwise adjust, control, or program, microcontroller 231.

One or more sensors 246 are configured to sense one or more operational characteristics of or associated with load 245 of heater 242. The one or more sensors 246 may comprise, for example, one or more voltage sensors configured to sense a voltage of or associated with load 245, one or more current sensors configured to sense a current of or associated with load 245, and/or one or more temperature sensors configured to sense a temperature of or associated with load 245.

Output of the one or more sensors 246 may be provided as or utilized in determining FuSa feedback 218. In the illustrated example, FuSa feedback 218 is also provided to microcontroller 231 which may perform similar evaluations of FuSa feedback 218 as microcontroller 207 but without meeting the FuSa requirements of FSCU 232. FuSa feedback 218 is preferably provided to FSCU 232 via a communication link with the ability to operate independently of other control circuitry of HCU 234, for example, via one or more dedicated communication links.

One or more sensors 266 are configured to sense one or more operational characteristics of or associated with load 265 of heater 262. The one or more sensors 266 may comprise, for example, one or more voltage sensors configured to sense a voltage of or associated with load 265, one or more current sensors configured to sense a current of or associated with load 265, and/or one or more temperature sensors configured to sense a temperature of or associated with load 265.

Output of the one or more sensors 266 may be provided as or utilized in determining FuSa feedback 268. In the illustrated example, FuSa feedback 268 is also provided to microcontroller 231 which may perform similar evaluations of FuSa feedback 268 as microcontroller 207 but without meeting the FuSa requirements of FSCU 232. FuSa feedback 268 is preferably provided to FSCU 232 via a communication link with the ability to operate independently of other control circuitry of HCU 234, for example, via one or more dedicated communication links which may be the same as or separate and distinct from the one or more dedicated communication links over which FuSa feedback 218 is transmitted.

In the illustrated embodiment, power converter 236 is configured and provided as a DC-DC power converter which is operatively coupled with and configured to receive DC power from power supply 220 which may provide such electrical power from one or more electrical storage and/or generation systems. In some forms, power converter 236 may be configured and provided in the form of a buck converter such as an interleaved buck converter. In other embodiments, power converter 236 may be configured and provided as another type of DC-DC converter. In other embodiments, power converter 236 may be configured and provided as AC-DC power converter which is operatively coupled with and configured to receive AC power from power supply 220.

Power converter 236 is further operatively coupled with and configured to drive heater 242 using power from power supply 220. Driver integrated circuit (IC) 234 is operatively coupled with and configured to receive control commands from microcontroller 231 and, in response to such control commands, to provide output to drive power converter 236. Driver IC 235 is also operatively coupled with and configured to receive an enable command or signal from interlock circuitry 233.

In the illustrated embodiment, power converter 266 is configured and provided as a DC-DC power converter which is operatively coupled with and configured to receive DC power from power supply 220 which may provide such electrical power from one or more electrical storage and/or generation systems. In some forms, power converter 266 may be configured and provided in the form of a buck converter such as an interleaved buck converter. In other embodiments, power converter 266 may be configured and provided as another type of DC-DC converter. In other embodiments, power converter 266 may be configured and provided as AC-DC power converter which is operatively coupled with and configured to receive AC power from power supply 220.

Power converter 266 is further operatively coupled with and configured to drive heater 242 using power from power supply 220. Driver integrated circuit (IC) 265 is operatively coupled with and configured to receive control commands from microcontroller 231 and, in response to such control commands, to provide output to drive power converter 266. Driver IC is also operatively coupled with and configured to receive an enable command or signal from interlock circuitry 233.

Interlock circuitry 233 is operatively coupled with and configured to receive interlock enable signal 211 from FSCU 232, In the illustrated embodiment, interlock circuitry 233 is also operatively coupled with another interlock enable signal from microcontroller 231, and an enable signal from a watchdog timer which may be implemented in or in connection with microcontroller 231 or other control circuitry HCU 234 or FSCU 232. Interlock circuitry 233 may be configured to disable operation of HCU when any one or more of the inputs which it receives has a logical false value.

FSCU 232 is configured to send communication to PSCU 219 and receive communication from PSCU 219 via one or more datalinks 210. FSCU 232 is also configured to provide enable signal 281 to PSCU 219. Enable signal 281 may be sent and utilized to switch off PSCU 219 and thereby indirectly disable operation of HCU 234 under certain conditions, for example, if an error, fault, or malfunction prevents FSCU 232 from successfully disabling or shutting off HCU 234 in the event of an error, fault, or malfunction. In some embodiments, FSCU 232 may additional be configured to send electrical power to control circuitry of PSCU 219 and/or to receive additional FuSA feedback from PSCU 219 to provide a substantially similar functional safety relationship and functionality of FSCU 232 and PSCU 219 as that of FSCU 232 and HCU 234.

The architectures and topologies described in connection with FIGS. 1-3 may be utilized and provide in a number of forms. Some such forms may comprise a first power converter channel such as the channel of power converter 236 configured to drive a first heater such as heater 242, and a second power converter channel such as the channel of power converter 266 configured to drive a second heater such as heater 262. Some such forms may comprise different arrangement of multichannel power converters and heater loads including the following examples.

Figure 4:
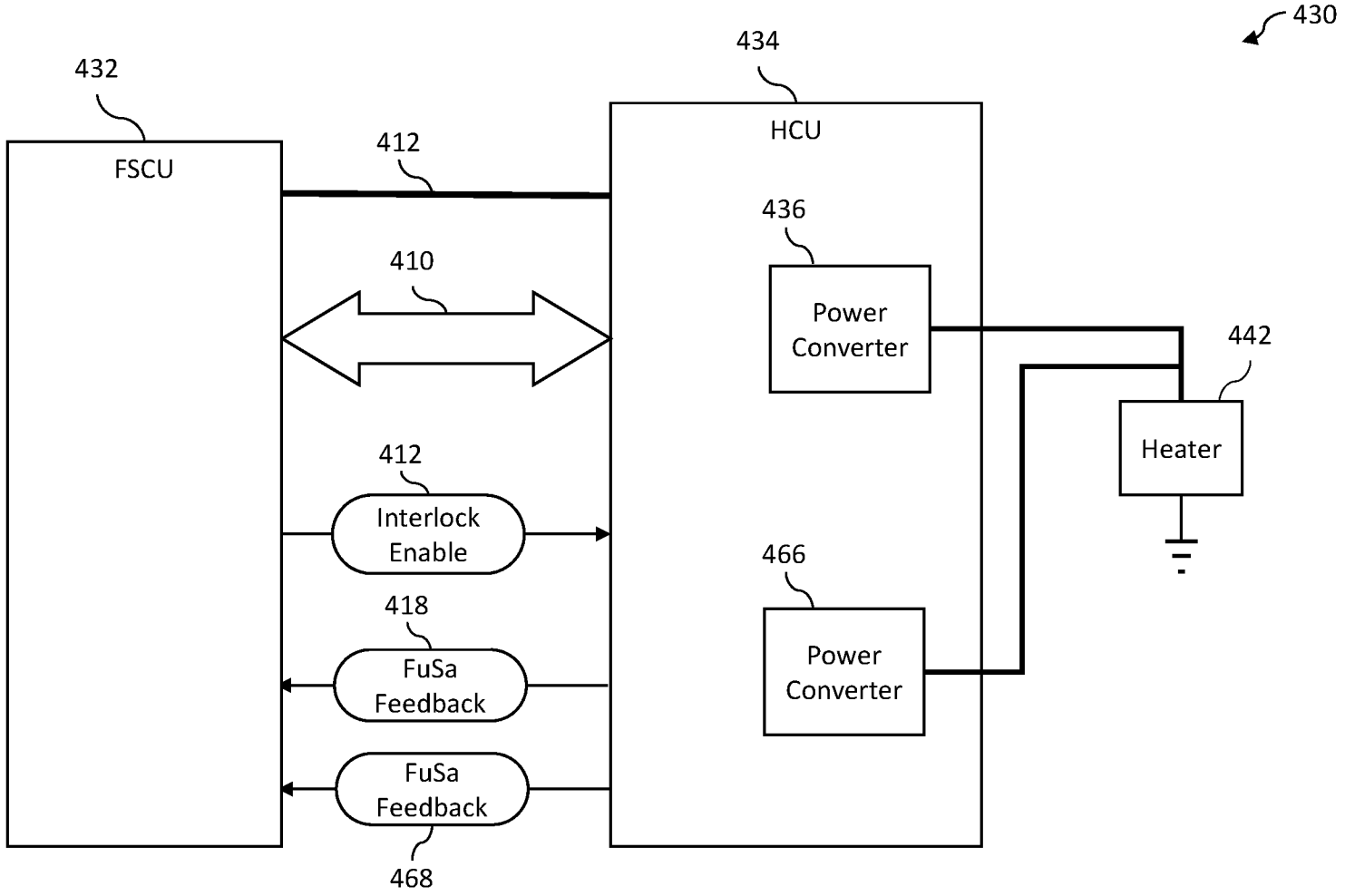

With reference to FIG. 4, there are illustrated certain aspects of another example electronic control system (ECS) 430 providing another example arrangement of multichannel power converters and heater loads. A number of the illustrated features of ECS 430 generally correspond to those of ECS 230 with the reference numerals of ECS 430 being incremented by 200. It shall likewise be appreciated that ECS 430 includes the other features described in connection with of ECS 230 which are not illustrated in FIG. 4.

Figure 5:
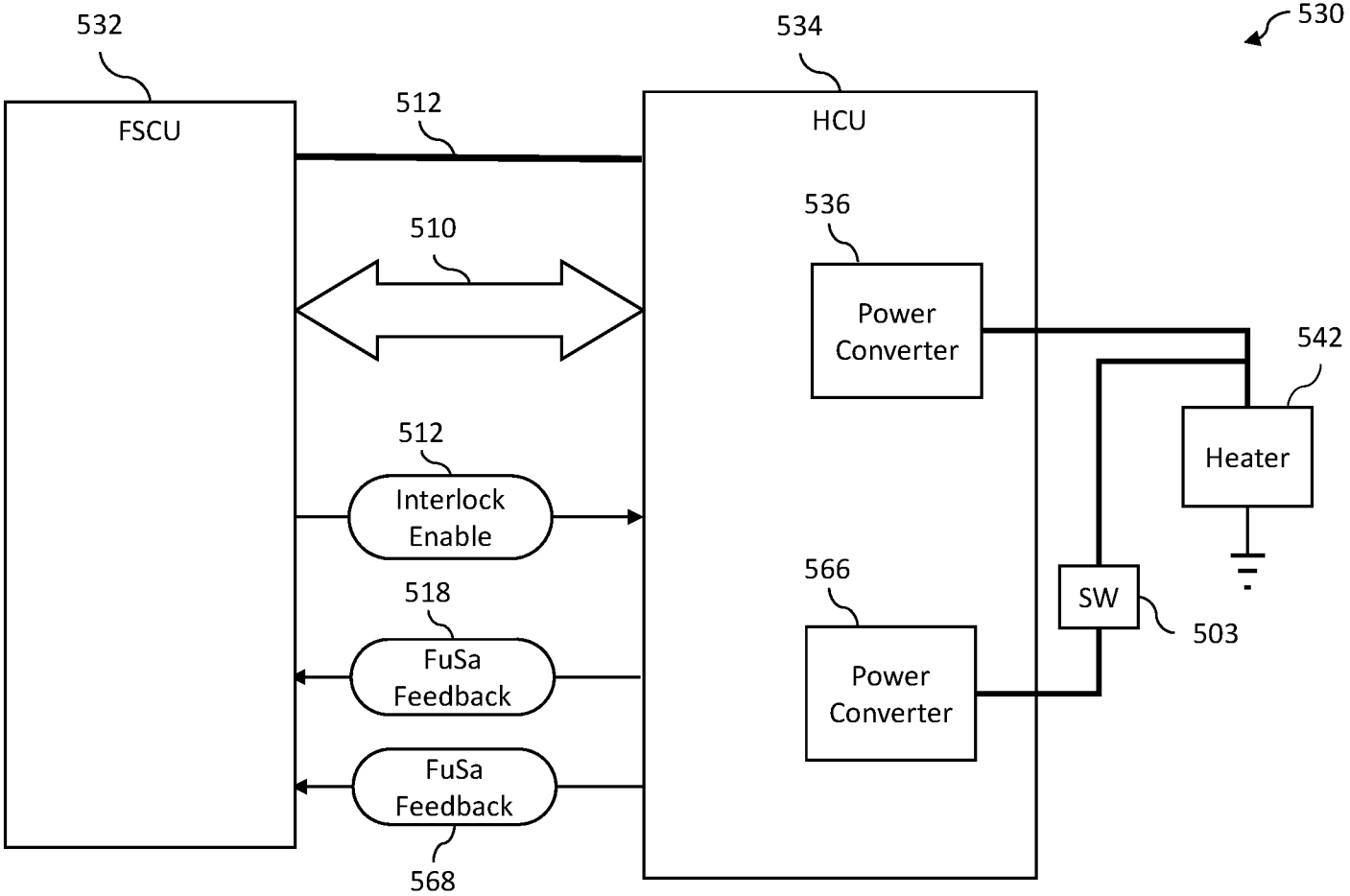

In ECS 430, HCU 434 includes a first output channel via which power converter 436 selectably outputs power to drive heater 442 and a second output channel via which power converter 466 selectably outputs power to drive heater 442. This arrangement allows the heater to be driven at twice the rated power that would be provided by a single channel output. For example, two 5 kW channels may drive a 10 kW heater load, or two 10 kW channels may drive a 20 kW heater With reference to FIG. 5, there are illustrated certain aspects of another example electronic control system (ECS) 530 providing another example arrangement of multichannel power converters and heater loads. A number of the illustrated features of ECS 530 generally correspond to those of ECS 230 with the reference numerals of ECS 530 being incremented by 300. It shall likewise be appreciated that ECS 530 includes the other features described in connection with of ECS 230 which are not illustrated in FIG. 5.

In ECS 530, HCU 534 includes a first output channel via which power converter 536 selectably outputs power to drive heater 542 and a second output channel via which power converter 566 selectably outputs power to drive heater 542. ECS 530 further includes a switch 503 which is controllable by HCU 534 and/or FSCU 532 to selectably couple and decouple the second output channel from heater 542. This arrangement allows the heater to be selectably driven at a single channel rated power and a double the single channel rated power. For example, two 5 kW channels may be selectably operated to drive heater load at 5 kW or at 10 kW, or two 10 kW channels may be selectably operated to drive a heater load at 10 kW or at 20 kW.

Figure 6:
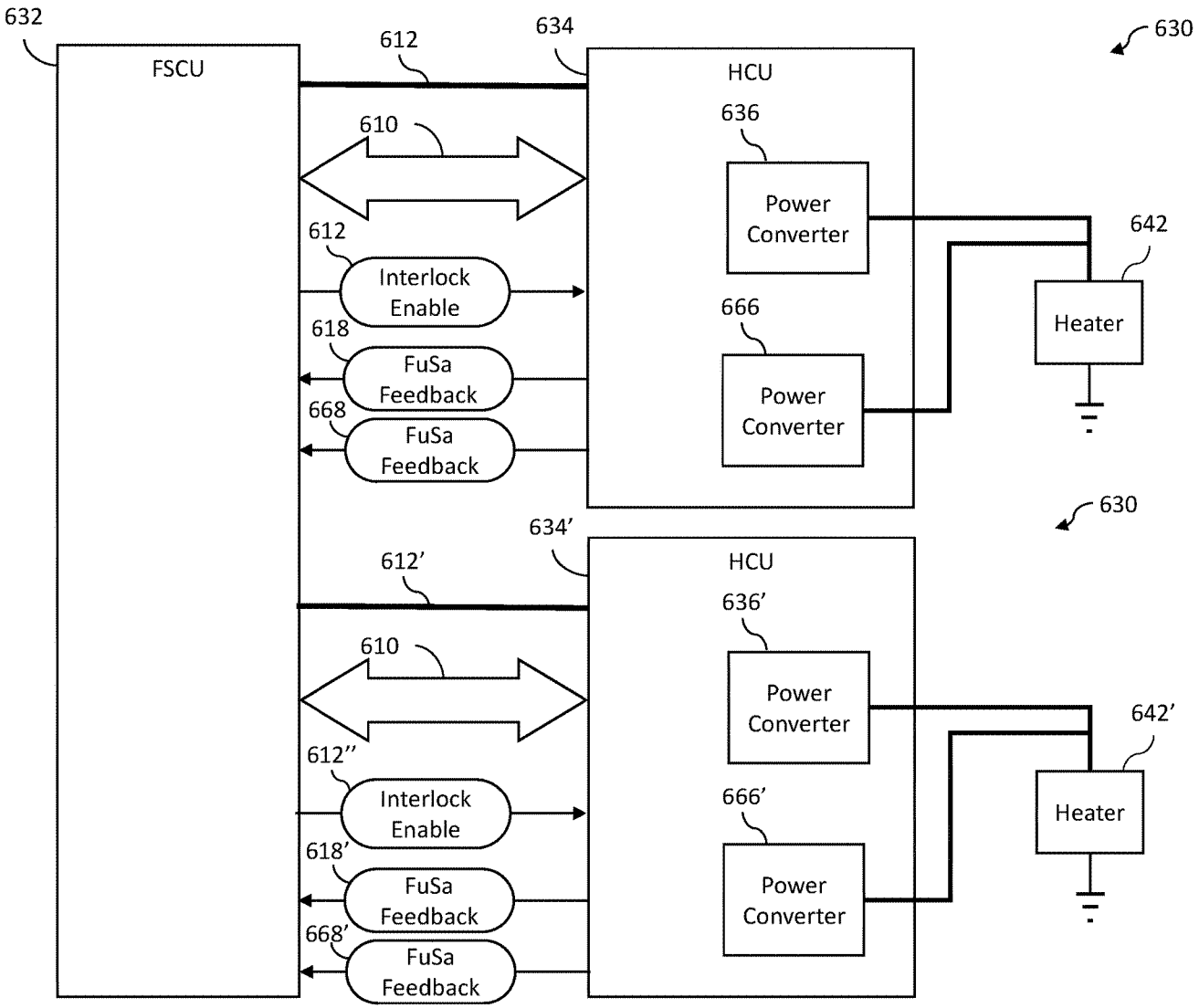

With reference to FIG. 6, there are illustrated certain aspects of another example electronic control system (ECS) 630 providing another example arrangement of multichannel power converters and heater loads. A number of the illustrated features of ECS 430 generally correspond to those of ECS 230 with the reference numerals of ECS 430 being incremented by 400. Furthermore, additional instance of such features are indicated with reference numerals incremented by 400 followed by an apostrophe or prime symbol. It shall likewise be appreciated that ECS 630 includes the other features described in connection with of ECS 230 which are not illustrated in FIG. 6.

In ECS 630, HCU 634 includes a first output channel via which power converter 636 selectably outputs power to drive heater 642 and a second output channel via which power converter 666 selectably outputs power to drive heater 642. This arrangement allows the heater to be driven at twice the rated power that would be provided by a single channel output. For example, two 5 kW channels may drive a 10 kW heater load, or two 10 kW channels may drive a 20 kW heater. It is further contemplated that a switch similar to switch 503 of ECS 530 may be provided to provide the functionality described in connection therewith.

In ECS 630, HCU 634' includes a first output channel via which power converter 636' selectably outputs power to drive heater 642' and a second output channel via which power converter 666' selectably outputs power to drive heater 642'. This arrangement allows the heater to be driven at twice the rated power that would be provided by a single channel output. For example, two 5 kW channels may drive a 10 kW heater load, or two 10 kW channels may drive a 20 kW heater. It is further contemplated that a switch similar to switch 503 of ECS 530 may be provided to provide the functionality described in connection therewith.

Figure 7:
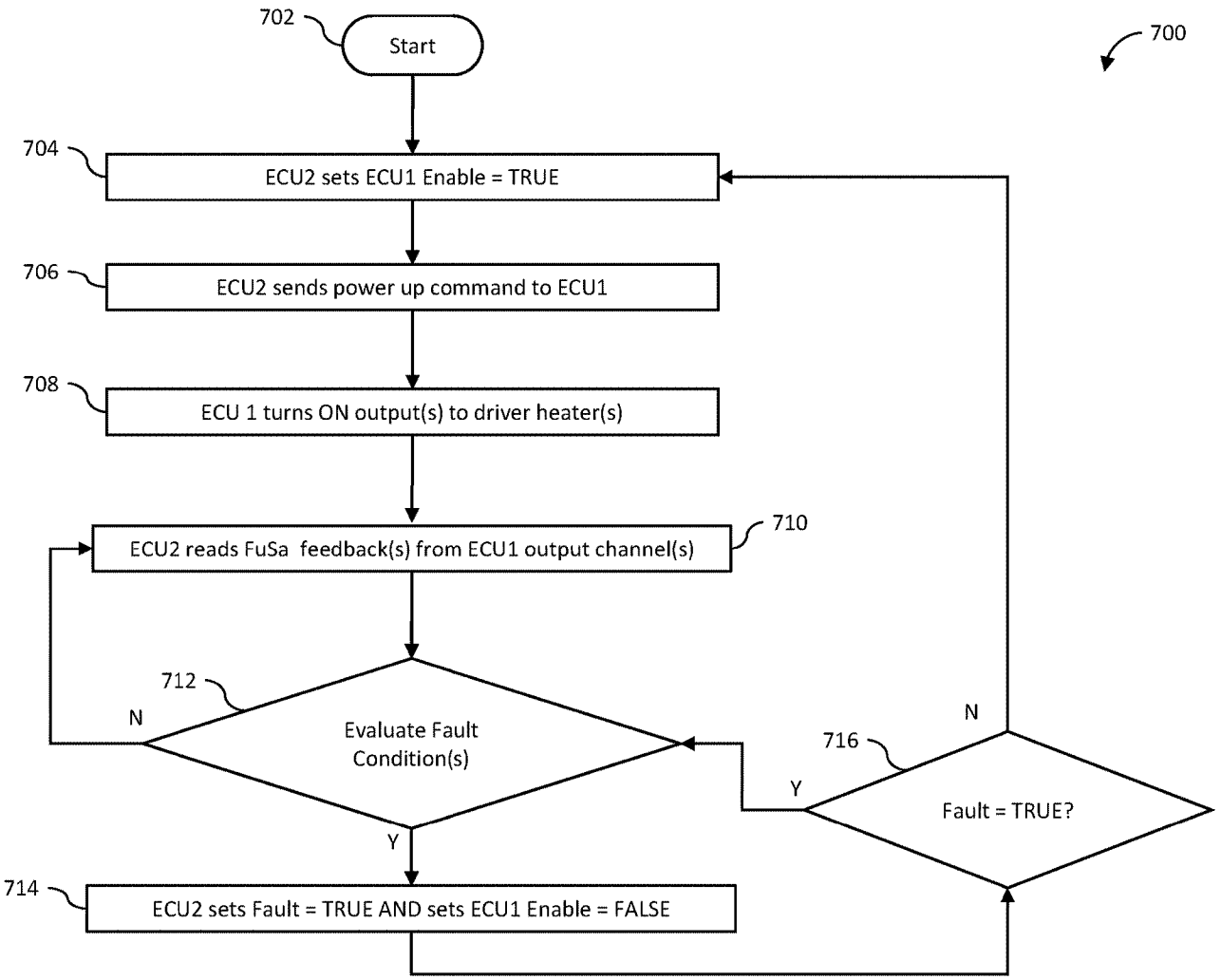
FIG. 7 is a flowchart illustrating certain aspects of an example control process.

With reference to FIG. 7, there is illustrated a flowchart depicting certain aspects of an example control process 700 (also referred to herein as process 700). Process 700 is described in connection with a first ECU and a second ECU. The first ECU may correspond to HCU 234, any of the other HCU described herein, or to another electronic control unit configured not to satisfy a predetermined functional safety (FuSa) requirement. The second ECU may correspond to FSCU 232, any of the other FSCU described herein, or to another electronic control unit configured to satisfy the predetermined FuSa requirement.

Process 700 begins at start operation 702 and proceeds to operation 704 at which the second ECU enables operation of the first ECU, for example, by setting a logical value of an interlock enable signal to true and/or by outputting a wake signal to the first ECU. From operation 704, process 700 proceeds to operation 706 at which the second ECU sends a power up command to the first ECU. From operation 706, process 700 proceeds to operation 708 at which the first ECU turns on one or more out channels to drive a load (e.g., a heater coil) of one or more heaters.

From operation 708, process 700 proceeds to operation 710 at which the second ECU reads one or more FuSa feedback parameters providing information indicative of a state of one or more corresponding output channels of the first ECU. In some embodiments, the one or more FuSa feedback parameters may comprise one or more voltage values which may be evaluated relative to one or more voltage thresholds to evaluate or identify an under-voltage and/or over-voltage condition of the heater. In some embodiments, the one or more FuSa feedback parameters may consist of or consist essentially of one or more voltage values which may be evaluated relative to one or more voltage thresholds to evaluate or identify an under-voltage and/or over-voltage condition of the heater. In some embodiments, the one or more FuSa feedback parameters may comprise one or more current values which may be evaluated relative to one or more current thresholds to evaluate or identify an under-current and/or over-current condition of the heater. In some embodiments, the one or more FuSa feedback parameters may comprise one or more temperature values which may be evaluated relative to one or more temperature thresholds to evaluate or identify an over-temperature condition of the heater. In some embodiments, the one or more FuSa feedback parameters may comprise combinations of the foregoing values or other values which may relative to corresponding thresholds.

From operation 710, process 700 proceeds to operation 712 at which the second ECU evaluates the one or more FuSa feedback for one or more fault conditions. In some embodiments, the evaluating the one or more FuSa feedback parameters may comprise evaluating one or more voltage values relative to one or more voltage thresholds to evaluate or identify an under-voltage and/or over-voltage condition. In some embodiments, the evaluating the one or more FuSa feedback parameters may consist of or consist essentially of evaluating one or more voltage values relative to one or more voltage thresholds to evaluate or identify an under-voltage and/or over-voltage condition of the heater. In some embodiments, the evaluating the one or more FuSa feedback parameters may comprise evaluating one or more current values relative to one or more current thresholds to evaluate or identify an under-current and/or over-current condition of the heater. In some embodiments, the evaluating the one or more FuSa feedback parameters may comprise evaluating one or more temperature values relative to one or more temperature thresholds to evaluate or identify an over-temperature condition of the heater. In some embodiments, the evaluating the one or more FuSa feedback parameters may comprise combinations of the foregoing evaluations or other evaluations relative to corresponding thresholds.

If conditional 712 evaluates negative, process 700 proceeds to operation 710. If conditional 712 evaluates affirmative, process 700 proceeds to operation 714 at which the second ECU sets a fault value equal to true and sets disables operation of the first ECU, for example, by setting a logical value of an interlock enable signal to false, by turning off power to the first ECU, by commanding the first ECU not to operate, or by performing a combination of two or more the foregoing operations or other operations.

From operation 714, process 700 proceeds to conditional 716 which evaluates whether a fault condition is true. If conditional 716 evaluates negative, process 700 proceeds to operation 714. If conditional 716 evaluates affirmative process 700 proceeds to conditional 712.

As shown by this detailed description, the present disclosure contemplates multiple and various embodiments, including, without limitation, the following example embodiments.

A first example embodiment is a prime mover system comprising: an engine; an aftertreatment system configured to treat exhaust of the engine; an electrical power source; a heater configured to selectably heat the aftertreatment system; and an electronic control system comprising a first electronic control unit configured to selectably drive the heater using power from the electrical power source, and a second electronic control unit configured to selectably enable and disable operation of the first electronic control unit to drive the heater in response to a feedback received from the first electronic control unit, the second electronic control unit being configured to meet predetermined functional safety requirements, the first electronic control unit being configured not to meet the predetermined functional safety requirements.

A second example embodiment includes the features of the first example embodiment, wherein the first electronic control unit comprises a power converter configured to convert power from the electrical power source to power the heater, and interlock circuitry configured to selectably enable and disable the power converter in response to a signal received from the second electronic control unit.

A third example embodiment includes the features of the first example embodiment, wherein the second electronic control unit is configured to supply electrical power from a second electrical power source to control circuitry of the first electronic control unit, the second electrical power source being independent of the electrical power source.

A fourth example embodiment includes the features of the third example embodiment, wherein the second electronic control unit is configured to selectably turn off the supply of electrical power to control circuitry of the first electronic control unit in response to the feedback.

A fifth example embodiment includes the features of the first example embodiment, wherein the feedback comprises a feedback indicative of a voltage of the heater.

A sixth example embodiment includes the features of the fifth example embodiment, wherein the second electronic control unit is configured to evaluate the feedback and to selectably disable operation of the first electronic control unit to drive the heater in response to an evaluation of the feedback received indicating one of an over-voltage condition and an under-voltage condition of the heater.

A seventh example embodiment includes the features of the first example embodiment, wherein the first electronic control unit includes a first power output channel and a second power output channel configured to selectably drive the heater.

An eighth example embodiment includes the features of the first example embodiment, wherein the electronic control system comprises a third electronic control unit configured to selectably drive the heater using power from the electrical power source, the second electronic control unit being configured to selectably enable and disable operation of the third electronic control unit to drive the second heater in response to a second feedback received from the third electronic control unit, the third electronic control configured not to meet the predetermined functional safety requirements.

A ninth example embodiment includes the features of the first example embodiment, wherein the electronic control system comprises a third electronic control unit configured to selectably drive a second heater using power from the electrical power source, the second electronic control unit being configured to selectably enable and disable operation of the third electronic control unit to drive the second heater in response to a second feedback received from the third electronic control unit, the third electronic control configured not to meet the predetermined functional safety requirements.

A tenth example embodiment is a process for controlling a prime mover system including an engine, an aftertreatment system configured to treat exhaust of the engine, an electrical power source, and a heater configured to selectably heat the aftertreatment system, and an electronic control system, the process comprising: operating a first electronic control unit of the electronic control system to selectably drive the heater using power from the electrical power source, providing a feedback from the first electronic control unit to a second electronic control unit of the electronic control system, and operating the second electronic control unit to selectably enable and disable operation of the first electronic control unit to drive the heater in response to the feedback, wherein the operating the second electronic control unit satisfies predetermined functional safety requirements, and the operating the first electronic control unit does not satisfy the predetermined functional safety requirements.

An eleventh example embodiment includes the features of the tenth example embodiment, wherein the operating a first electronic control unit of the electronic control system to selectably drive the heater using power from the electrical power source comprises operating a power converter of the first electronic control unit to convert power from the electrical power source to power the heater, and operating interlock circuitry to selectably enable operation of the power converter in response to a signal received from the second electronic control unit.

A twelfth example embodiment includes the features of the tenth example embodiment, comprising operating the second electronic control unit to supply electrical power from a second electrical power source to control circuitry of the first electronic control unit, the second electrical power source being independent of the first electrical power source.

A thirteenth example embodiment includes the features of the twelfth example embodiment, comprising operating the second electronic control unit to selectably turn off the supply of electrical power to control circuitry of the first electronic control unit in response to the feedback.

A fourteenth example embodiment includes the features of the tenth example embodiment, wherein the feedback comprises a feedback indicative of a voltage of the heater.

A fifteenth example embodiment includes the features of the fourteenth example embodiment, comprising operating the second electronic control unit to evaluate the feedback and to selectably disable operation of the first electronic control unit to drive the heater in response to an evaluation of the feedback received indicating one of an over-voltage condition and an under-voltage condition of the heater.

A sixteenth example embodiment includes the features of the tenth example embodiment, wherein the operating a first electronic control unit of the electronic control system to selectably drive the heater using power from the electrical power source comprises selectably driving the heater with a first a first power output channel and a second power output channel of the first electronic control unit.

A seventeenth example embodiment includes the features of the tenth example embodiment, comprising: operating a third electronic control unit of the electronic control system to selectably drive the heater using power from the electrical power source; providing a second feedback from the third electronic control unit to the second electronic control unit; and operating the second electronic control unit to selectably enable and disable operation of the first electronic control unit to drive the heater in response to the feedback; wherein the operating the operating the third electronic control unit does not satisfy the predetermined functional safety requirements.

An eighteenth example embodiment includes the features of the tenth example embodiment, comprising: operating a third electronic control unit of the electronic control system to selectably drive a second heater using power from the electrical power source; providing a second feedback from the third electronic control unit to the second electronic control unit; and operating the second electronic control unit to selectably enable and disable operation of the first electronic control unit to drive the second heater in response to the feedback; wherein the operating the operating the third electronic control unit does not satisfy the predetermined functional safety requirements.

A nineteenth example embodiment is an apparatus for controlling a prime mover system including an engine, an aftertreatment system configured to treat exhaust of the engine, an electrical power source, and a heater configured to selectably heat the aftertreatment system, the apparatus comprising: an electronic control system including a first electronic control unit configured to selectably drive the heater using power from the electrical power source, and a second electronic control unit configured to selectably enable and disable operation of the first electronic control unit to drive the heater in response to a feedback received from the first electronic control unit, wherein the second electronic control unit is configured to meet predetermined functional safety requirements, and the first electronic control configured not to meet the predetermined functional safety requirements.

A twentieth example embodiment includes the features of the nineteenth example embodiment, wherein the first electronic control unit comprises a power converter configured to convert power from the electrical power source to power the heater, and interlock circuitry configured to selectably enable and disable the power converter in response to a signal received from the second electronic control unit.

A twenty-first example embodiment includes the features of the nineteenth example embodiment, wherein the second electronic control unit is configured to supply electrical power from a second electrical power source to control circuitry of the first electronic control unit, the second electrical power source being independent of the first electrical power source.

A twenty-second example embodiment includes the features of the twenty-first example embodiment, wherein the second electronic control unit is configured to selectably turn off the supply of electrical power to control circuitry of the first electronic control unit in response to the feedback.

It shall be appreciated that terms such as "a non-transitory memory," "a non-transitory memory medium," and "a non-transitory memory device" refer to a number of types of devices and storage mediums which may be configured to store information, such as data or instructions, readable or executable by a processor or other components of a computer system and that such terms include and encompass a single or unitary device or medium storing such information, multiple devices or media across or among which respective portions of such information are stored, and multiple devices or media across or among which multiple copies of such information are stored.

It shall be appreciated that terms such as "determine," "determined," "determining" and the like when utilized in connection with a control method or process, an electronic control system or controller, electronic controls, or components or operations of the foregoing refer inclusively to a number of acts, configurations, devices, operations, and techniques including, without limitation, calculation or computation of a parameter or value, obtaining a parameter or value from a lookup table or using a lookup operation, receiving parameters or values from a datalink or network communication, receiving an electronic signal (e.g., a voltage, frequency, current, or pulse-width modulation (PWM) signal) indicative of the parameter or value, receiving output of a sensor indicative of the parameter or value, receiving other outputs or inputs indicative of the parameter or value, reading the parameter or value from a memory location on a computer-readable medium, receiving the parameter or value as a run-time parameter, and/or by receiving a parameter or value by which the interpreted parameter can be calculated, and/or by referencing a default value that is interpreted to be the parameter value.

While example embodiments of the disclosure have been illustrated and described in detail in the drawings and foregoing description, the same is to be considered as illustrative and not restrictive in character, it being understood that only certain example embodiments have been shown and described and that all changes and modifications that come within the spirit of the claimed inventions are desired to be protected. It should be understood that while the use of words such as preferable, preferably, preferred or more preferred utilized in the description above indicates that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A prime mover system comprising:

an engine;

an aftertreatment system configured to treat exhaust of the engine;

an electrical power source;

a heater configured to selectably heat the aftertreatment system; and an electronic control system comprising a first electronic control unit configured to selectably drive the heater using power from the electrical power source, and a second electronic control unit configured to selectably enable and disable operation of the first electronic control unit to drive the heater in response to a feedback received from the first electronic control unit, the second electronic control unit being configured to meet predetermined functional safety requirements, the first electronic control unit being configured not to meet the predetermined functional safety requirements, wherein the second electronic control unit is configured to selectably enable and disable operation of the first electronic control unit using a first signal sent via a first datalink from a microcontroller of the second electronic control unit to a microcontroller of the first electronic control unit, and a second signal sent via a second datalink from the microcontroller of the second electronic control to interlock circuitry configured to disable a driver of the first electronic control unit.

2. The prime mover system of claim 1, wherein the first electronic control unit comprises a power converter configured to convert power from the electrical power source to power the heater.

3. The prime mover system of claim 1, wherein the second electronic control unit is configured to supply electrical power from a second electrical power source to control circuitry of the first electronic control unit, the second electrical power source being independent of the electrical power source.

4. The prime mover system of claim 3, wherein the second electronic control unit is configured to selectably turn off the supply of electrical power to control circuitry of the first electronic control unit in response to the feedback.

5. The prime mover system of claim 1, wherein the feedback comprises a feedback indicative of a voltage of the heater.

6. The prime mover system of claim 5, wherein the second electronic control unit is configured to evaluate the feedback and to selectably disable operation of the first electronic control unit to drive the heater in response to an evaluation of the feedback received indicating one of an over-voltage condition and an under-voltage condition of the heater.

7. The prime mover system of claim 1, wherein the first electronic control unit includes a first power output channel and a second power output channel configured to selectably drive the heater.

8. The prime mover system of claim 1, wherein the electronic control system comprises a third electronic control unit configured to selectably drive the heater using power from the electrical power source, the second electronic control unit being configured to selectably enable and disable operation of the third electronic control unit to drive the second heater in response to a second feedback received from the third electronic control unit, the third electronic control configured not to meet the predetermined functional safety requirements.

9. The prime mover system of claim 1, wherein the electronic control system comprises a third electronic control unit configured to selectably drive a second heater using power from the electrical power source, the second electronic control unit being configured to selectably enable and disable operation of the third electronic control unit to drive the second heater in response to a second feedback received from the third electronic control unit, the third electronic control configured not to meet the predetermined functional safety requirements.

10. A process for controlling a prime mover system including an engine, an aftertreatment system configured to treat exhaust of the engine, an electrical power source, and a heater configured to selectably heat the aftertreatment system, and an electronic control system, the process comprising:

operating a first electronic control unit of the electronic control system to selectably drive the heater using power from the electrical power source, providing a feedback from the first electronic control unit to a second electronic control unit of the electronic control system, and operating the second electronic control unit to selectably enable and disable operation of the first electronic control unit to drive the heater in response to the feedback, wherein the operating the second electronic control unit satisfies predetermined functional safety requirements, and the operating the first electronic control unit does not satisfy the predetermined functional safety requirements wherein operating the second electronic control unit to selectably enable and disable operation of the first electronic control unit comprises either or both of sending a first signal from a microcontroller of the second electronic control unit to a microcontroller of the first electronic control unit, and sending a second signal sent from the microcontroller of the second electronic control to interlock circuitry configured to disable a driver of the first electronic control unit.

11. The process of claim 10, wherein the operating a first electronic control unit of the electronic control system to selectably drive the heater using power from the electrical power source comprises operating a power converter of the first electronic control unit to convert power from the electrical power source to power the heater.

12. The process of claim 10, comprising operating the second electronic control unit to supply electrical power from a second electrical power source to control circuitry of the first electronic control unit, the second electrical power source being independent of the first electrical power source.

13. The process of claim 12, comprising operating the second electronic control unit to selectably turn off the supply of electrical power to control circuitry of the first electronic control unit in response to the feedback.

14. The process of claim 10, wherein the feedback comprises a feedback indicative of a voltage of the heater.

15. The process of claim 14, comprising operating the second electronic control unit to evaluate the feedback and to selectably disable operation of the first electronic control unit to drive the heater in response to an evaluation of the feedback received indicating one of an over-voltage condition and an under-voltage condition of the heater.

16. The process of claim 10, wherein the operating a first electronic control unit of the electronic control system to selectably drive the heater using power from the electrical power source comprises selectably driving the heater with a first a first power output channel and a second power output channel of the first electronic control unit.

17. The process of claim 10, comprising:

operating a third electronic control unit of the electronic control system to selectably drive the heater using power from the electrical power source;

providing a second feedback from the third electronic control unit to the second electronic control unit; and operating the second electronic control unit to selectably enable and disable operation of the first electronic control unit to drive the heater in response to the feedback;

wherein the operating the operating the third electronic control unit does not satisfy the predetermined functional safety requirements.

18. The process of claim 10, comprising:

operating a third electronic control unit of the electronic control system to selectably drive a second heater using power from the electrical power source;

providing a second feedback from the third electronic control unit to the second electronic control unit; and operating the second electronic control unit to selectably enable and disable operation of the first electronic control unit to drive the second heater in response to the feedback;

wherein the operating the operating the third electronic control unit does not satisfy the predetermined functional safety requirements.

19. An apparatus for controlling a prime mover system including an engine, an aftertreatment system configured to treat exhaust of the engine, an electrical power source, and a heater configured to selectably heat the aftertreatment system, the apparatus comprising:

an electronic control system including a first electronic control unit configured to selectably drive the heater using power from the electrical power source, and a second electronic control unit configured to selectably enable and disable operation of the first electronic control unit to drive the heater in response to a feedback received from the first electronic control unit, wherein the second electronic control unit is configured to meet predetermined functional safety requirements, and the first electronic control configured not to meet the predetermined functional safety requirements, wherein the second electronic control unit is configured to selectably enable and disable operation of the first electronic control unit using a first datalink operatively coupling a microcontroller of the second electronic control unit to a microcontroller of the first electronic control unit, and a second datalink operatively coupling from the microcontroller of the second electronic control to interlock circuitry configured to disable a driver of the first electronic control unit.

20. The apparatus of claim 19, wherein the first electronic control unit comprises a power converter configured to convert power from the electrical power source to power the heater.

21. The apparatus of claim 19, wherein the second electronic control unit is configured to supply electrical power from a second electrical power source to control circuitry of the first electronic control unit, the second electrical power source being independent of the first electrical power source.

22. The apparatus of claim 21, wherein the second electronic control unit is configured to selectably turn off the supply of electrical power to control circuitry of the first electronic control unit in response to the feedback.

* * * * *